US007586069B2

(12) United States Patent
Inoue et al.

(10) Patent No.: US 7,586,069 B2
(45) Date of Patent: Sep. 8, 2009

(54) INNER BOX FOR COOKER AND METHOD OF INTEGRATING THE SAME

(75) Inventors: Takahiro Inoue, Nara (JP); Kiyoto Ishida, Yamatokooriyama (JP); Susumu Idomoto, Yamatokooriyama (JP)

(73) Assignee: Panasonic Corporation, Osaka (JP)

( * ) Notice: Subject to any disclaimer, the term of this patent is extended or adjusted under 35 U.S.C. 154(b) by 429 days.

(21) Appl. No.: 10/800,062

(22) Filed: Mar. 12, 2004

(65) Prior Publication Data

US 2004/0232134 A1 Nov. 25, 2004

(30) Foreign Application Priority Data

Mar. 13, 2003 (JP) ..... P. 2003-068221

(51) Int. Cl.
*H05B 6/64* (2006.01)

(52) U.S. Cl. ..... 219/756; 219/738; 219/739; 126/273 R

(58) Field of Classification Search ..... 219/756, 219/738, 752, 739, 685, 704, 762, 751, 401, 219/402, 404; 220/619, 620, 431, 689; 126/273 R, 126/21 R, 19 R, 190, 200; 29/509, 513, 521
See application file for complete search history.

(56) References Cited

U.S. PATENT DOCUMENTS 4,563,559 A * 1/1986 Enami ..... 219/756
4,609,801 A * 9/1986 Spencer et al. ..... 219/756

FOREIGN PATENT DOCUMENTS

| | | |
|---|---|---|
| JP | 59-172904 | 11/1984 |
| JP | 6099404 | 7/1985 |
| JP | 60259832 | 12/1985 |
| JP | 264810 | 5/1990 |
| JP | 02179324 | 7/1990 |

OTHER PUBLICATIONS

Japanese Office action with English translation.

* cited by examiner

*Primary Examiner*—Quang T Van
(74) *Attorney, Agent, or Firm*—Pearne & Gordon LLP

(57) ABSTRACT

An inner box for a cooker is provided including a front plate having an opening portion and an inner box main body bonded to a peripheral edge of the opening portion comprising a first fold-to-bend portion constituted by folding to bend an end portion thereof to invert to be brought into close contact therewith and a second fold-to-bend portion constituted by inverting a portion on a side of the end portion of the first fold-to-bend portion with a predetermined clearance therebetween and a flange portion inserted into the clearance between the first fold-to-bend portion and the second fold-to-bend portion, and wherein the bonding portions of the front plate and the inner box main body are constituted by a structure of inserting the flange portion into the clearance to be calked to bond therewith.

2 Claims, 10 Drawing Sheets

INNER BOX FOR COOKER AND METHOD OF INTEGRATING THE SAME

BACKGROUND OF THE INVENTION

The present invention relates to an inner box for a cooker formed by bonding a plurality of sheets of plate members, particularly relates to an improvement in a bonding portion of a face plate.

Conventionally, a plate constitution of an inner box for a cooker is constituted by a front plate 51 having an opening portion, a rear plate 53, an inner box main body 55 provided between the front plate 51 and the rear plate 53, and a ceiling plate 57 covering from an upper face thereof as generally shown by FIG. 9.

In such an inner box main body 55, as shown by a bonding portion for bonding the front plate 51 and a face plate 61 of the inner box main body 55 in FIG.10(*a*), an end edge of the opening portion of the front plate 51 is formed with a fold-to-bend portion 59, and a fold-to-bend portion 63 constituting a V-like shape relative to a face of the front plate 51 and skewedly projected to the face plate 61 of the inner box main body 55 is formed from the fold-to-bend portion 59. Meanwhile, also at an end portion of the face plate 61 of the inner box main body 55, similar to the front plate 51, an end edge thereof is formed with a fold-to-bend portion 65 and a front end portion 65*a* thereof is arranged on an inner side of the fold-to-bend portion 63 to prepare for a calking step.

Further, as shown by FIG. 10(*b*), in the calking step, in a state of supporting a lower side in the drawing of the front plate 51, while inserting the front end portion 65*a* of the fold-to-bend portion of the face plate 61 into a space between the fold-to-bend portion 63 of the front plate 51 and the front plate 51, a calking jig, not illustrated, is pressed from above the face plate 61 to the front plate 51 over an entire periphery of the bonding portion for bonding the face plate 61 and the front plate 51. Thereby, the fold-to-bend portion 63 of the front plate 51 and the fold-to-bend portion 65 of the face plate 61 are brought into close contact with each other by being sandwiched by each other to thereby fix the front plate 51 and the face plate 61 of the inner box main body by end calking (refer to, for example, Japanese Utility Model Publication JP-UM-A-59-172904).

However, according to the above-described inner box for a cooker, four sheets of the face plates 61 to be bonded with the front plate 51 of the inner box main body 55 are simultaneously calked to bond to the front plate 51 and therefore, a pressure applied to the calking jig is considerable, further, also an equipment for the calking step becomes large-sized. Therefore, when the face plates 61 are successively bonded to the front plate 51 sheet by sheet instead of simultaneously calking to bond four sheets of the face plates 61 thereto, the calking step can be carried out simply and conveniently without applying the considerable pressure on the calking jig, however, a bonding structure having the above-described constitution poses the following problem.

That is, in pressing the face plate 61 of the inner box main body 55 by the calking jig, there is a play between the respective fold-to-bend portions 63, 65 in a pressing direction of the front plate 51 in calking, that is, both of the fold-to-bend portions 63, 65 are projected in height directions and therefore, a slide amount ΔH in the pressing direction of the face plate 61 is prolonged by pressing in calking. Therefore, when the calking step is carried out in a state of respectively dividing four sheets of the face plates 61 to be bonded with the front plate 51 of the inner box main body 55, the above-described difference in height of ΔH is produced between the face plate after the calking step and the face plate before the calking step contiguous thereto. By the difference in height, warping is produced in the inner box main body 55 bonded with four sheets of the face plates and also the front plate 51 is bent. When the calking step is continued in a state in which the respective face plates and the front plate are respectively bent in this way, the inner box 55 is finished in a state of the inner box 55 being warped, bent are buckled.

Further, there is a case of carrying out a surface treatment of, for example, precoated metal (PCM) or the like on a surface of the front plate 51 and surfaces of the respective face plates 61 of the inner box 55 to meet a request of promoting a beautiful outlook in household electric appliances in recent times. In this case, since the precoated metal is provided with insulating performance, when the faces which are brought into close contact with each other by the calking step are constituted only by insulating faces, the respective face plates 61 are brought into an unconducted state and when a high frequency wave is irradiated into the inner box 55 for cooking, radio wave shielding of the inner box 55 becomes incomplete and leakage of radio wave is brought about. Therefore, shapes of the fold-to-bend portions 63, 65 are restricted in view of design since the respective face plates 61 need to be connected electrically.

SUMMARY OF THE INVENTION

The invention has been carried out in order to resolve the above-described problem and it is an object there of to provide an inner box for a cooker capable of firmly carrying out a calking step for bonding by simple operation without requiring a large-sized equipment and capable of being integrated without a drawback of leakage of radio wave or the like at low cost and a method of integrating the same.

The above-described object is achieved by a constitution shown below.

(1) An inner box for a cooker which is an inner box for a cooker including a front plate having an opening portion and an inner box main body bonded to a peripheral edge of the opening portion for cooking at inside of the inner box main body, wherein at least either one of the bonding portions of the front plate and the inner box main body is formed with a first fold-to-bend portion constituted by folding to bend an end portion thereof to invert to be brought into close contact therewith and a second fold-to-bend portion constituted by inverting a portion on a side of an end portion of the first fold-to-bend portion with a predetermined clearance therebetween, other of the bonding portions of the front plate and the inner box main body is formed with a flange portion inserted into the clearance between the first fold-to-bend portion and the second fold-to-bend portion, and the bonding portions are constituted by a structure in which the flange portion is inserted into the clearance to be calked to bond.

According to the inner box for a cooker, the flange portion on other side is arranged to the clearance between the first fold-to-bend portion and the second fold-to-bend portion on one side to be bonded and calked to bond therewith to thereby fix the front plate and the inner box main body to be sandwiched to fix by the bonding portions. Therefore, the face plates of the inner box main body are calked to bond with the front plate at positions at which the face plates of the inner box main body are brought into contact with the front plate and a positional shift is hardly produced between the face plates and the front plate between before calking and after calking. Further, the face plates and the front plate are dividedly calked to bond without being calked to the entire periphery of the bonding portion in one motion by large pressure and therefore, bonding is carried out by comparatively small pressure. Therefore, the integrating process can be simplified without needing a large amount of equipment investment.

(2) In the inner box for a cooker, the second fold-to-bend portion may be formed with a locking hole and the flange portion is formed with a locking projection inserted into the locking hole.

According to the inner box for a cooker, a shift in the bonding position is difficult to be brought about by the locking hole at the second fold-to-bend portion on one side to be bonded and the locking projection at the flange portion on other side.

(3) The locking projection may be a projection formed by punching.

According to the inner box for a cooker, a dowel can be formed by simple pressing without attaching a member separately.

(4) Further, insulating films maybe formed on a surface of the front plate on a side opposed to a side of being connected with the inner box main body and an outer side surface of the inner box main body.

According to the inner box for a cooker, even when an electrically insulating surface treatment is carried out on the surface of the front plate or the inner box main body, a conductive path is formed and a radio wave shielding effect can be achieved without being influenced by the electrically insulating surface treatment coating. Further, by bringing the locking projection into face contact with an inner peripheral face of the locking hole by calking to bond, conduction can firmly be ensured.

(5) According to the present invention, in a method of integrating the inner box for a cooker, end portions of face plates of the inner box main body connected to the front plate are bonded to the front plate individually for the respective face plates.

According to the method of integrating the inner box for a cooker, the inner box main body is not warped, further, the calking step can be carried out without requiring a large-sized equipment and fabricating cost can be restrained.

DETAILED DESCRIPTION OF THE PREFERRED EMBODIMENTS

A detailed explanation will be given of an embodiment of an inner box for a cooker according to the invention and a method of integrating the same in reference to the drawings as follows.

Figure 1:
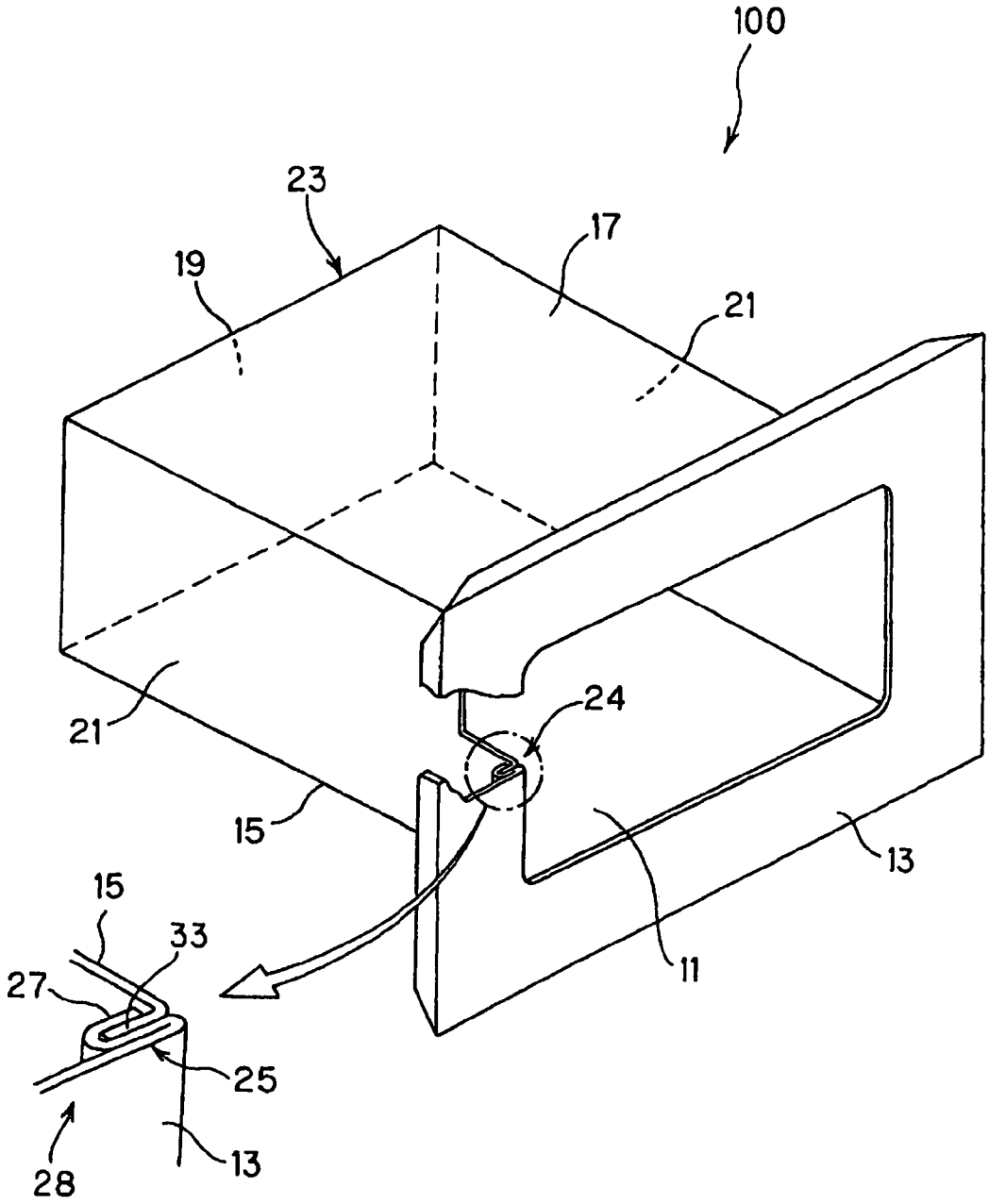
FIG. 1 is a partially disassembled outlook perspective view of an inner box for a cooker according to a first embodiment of the invention.
Figure 2:
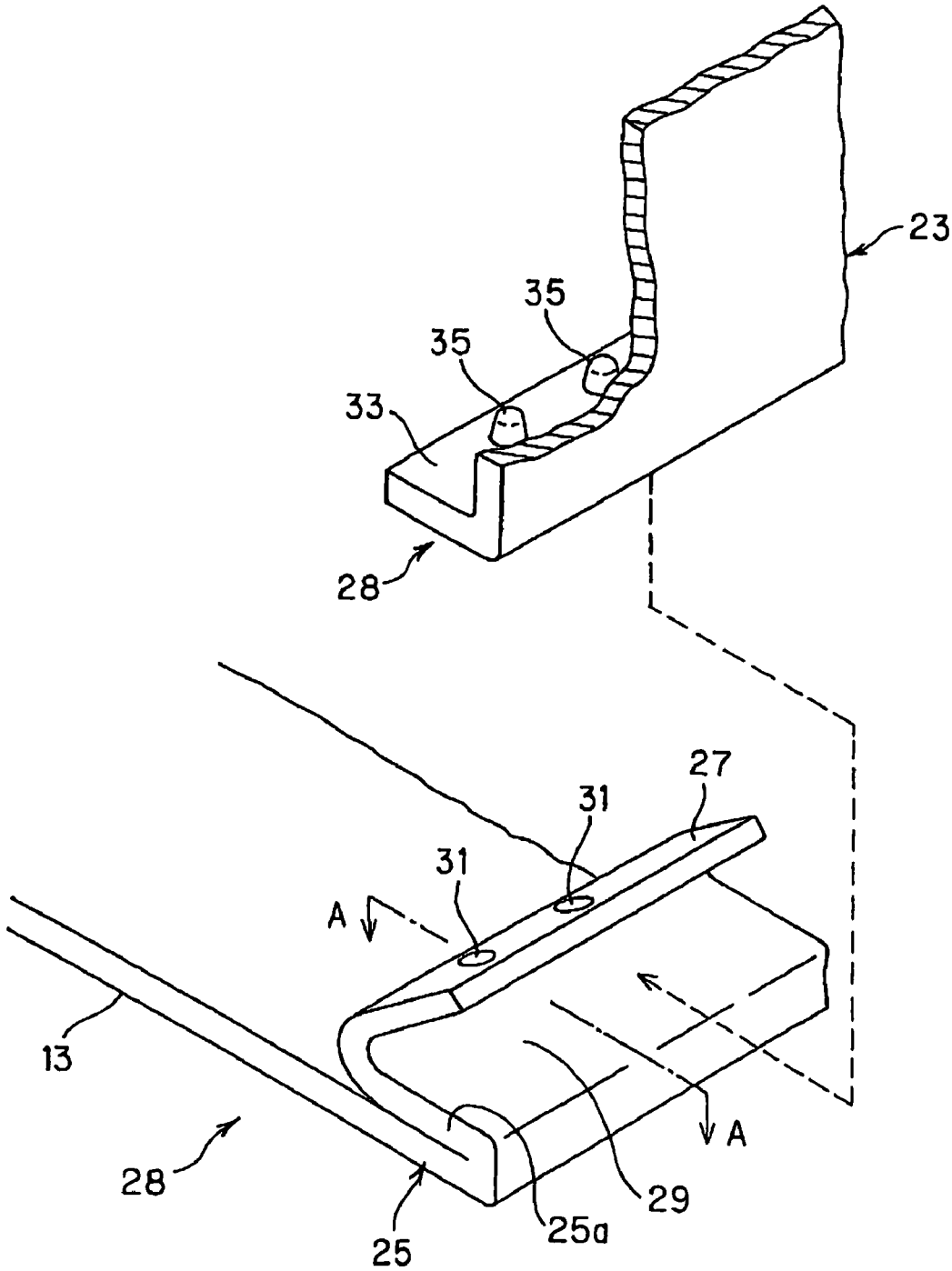
FIG. 2 is a partially enlarged view of the inner box for a cooker shown in FIG. 1 before a calking step.
Figure 3:
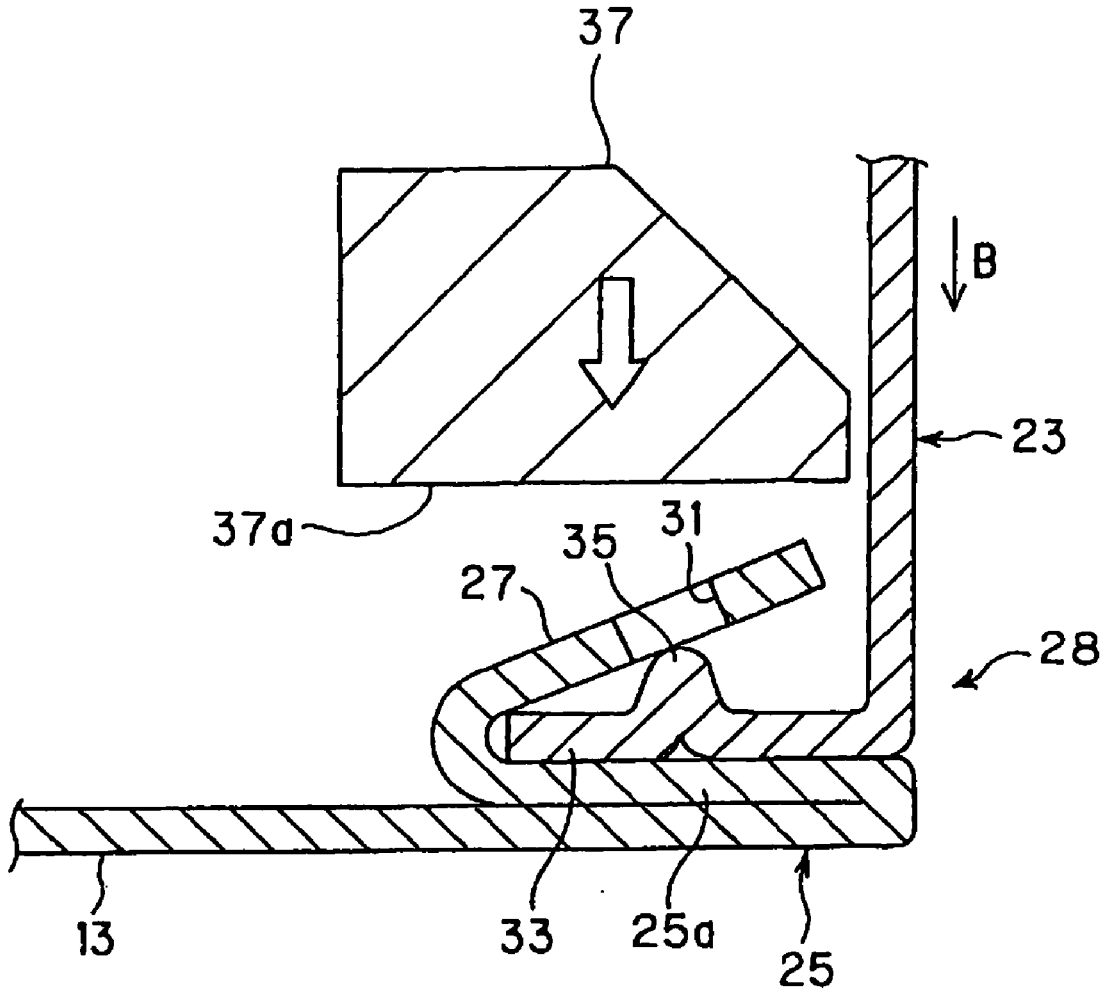
FIG. 3 is a sectional view taken along a line A-A of FIG. 2.

FIG. 1 is a partially disassembled outlook perspective view of an inner box for a cooker according to a first embodiment of the invention, FIG. 2 is a partially enlarged view of the inner box for a cooker shown in FIG. 1 before a calking step, and FIG. 3 is a sectional view taken along a line A-A of FIG. 2.

As shown by FIG. 1, an inner box 100 for a cooker according to the first embodiment of the invention is constituted by including an inner box main body 23 comprising a front plate 13 having an opening portion 11, a bottom plate 15, a ceiling plate 17, a rear plate 19, and a side plate 21, and when the inner box 100 is formed as a heating chamber of a high frequency cooker as an example of a cooker, the inner box 100 becomes a box member for heating an object to be heated contained at inside of the inner box by irradiating a high frequency wave into the inner box.

The front plate 13 is opposed to an opening/closing door, not illustrated, for closing the opening portion 11 (an inserting port of the object to be heated) and is formed with the opening portion 11 at a central portion thereof. A peripheral edge portion of the opening portion 11 is formed with a first fold-to-bend portion 25 constituted by folding to bend to invert an end portion thereof to be brought into close contact with the front plate 13, and a second fold-to-bend portion 27 constituted by inverting a portion of an end portion side of the first fold-to-bend portion 25 with a predetermined clearance therebetween. Thereby, the first fold-to-bend portion 25 and the second fold-to-bend portion 27 are formed substantially in U-shape. A bonding portion 28 of the faceplate 13 is calked to bond with four sheets of the face plates (the bottom plate 15, the ceiling plate 17, and the respective side plates 21) of the inner box main body 23.

FIG. 2 shows a conceptual partially enlarged disassembled view of before calking the bonding portion bonded with the inner box main body at the peripheral edge portion of the front plate 13.

An inverted portion 25*a* of the first fold-to-bend portion 25 is brought into close contact with the front plate 13 to promote a rigidity by an increase in a modulus of section. The second fold-to-bend portion 27 is inclined relative to the front plate 13 to open a clearance 29 in a state before calking. Further, the second fold-to-bend portion 27 is formed with a plurality of locking holes 31 in shapes of long holes which act as dowel holes at predetermined intervals along a direction of a peripheral edge of the bonding portion 28.

Meanwhile, a bonding portion of the face plate on a side of the inner box main body 23 is formed with a flange portion 33 inserted into the clearance 29 between the first fold-to-bend portion 25 and the second fold-to-bend portion 27 of the front plate 13. Further, the flange portion 33 is provided with a plurality of locking projections 35 which act as dowels in correspondence with the locking holes 31 on a side of the front plate 13. According to the locking projection 35, the projection can simply be formed by punching by pressing or the like from a rear face (lower side in the drawing) of the flange portion 33.

Figure 4:
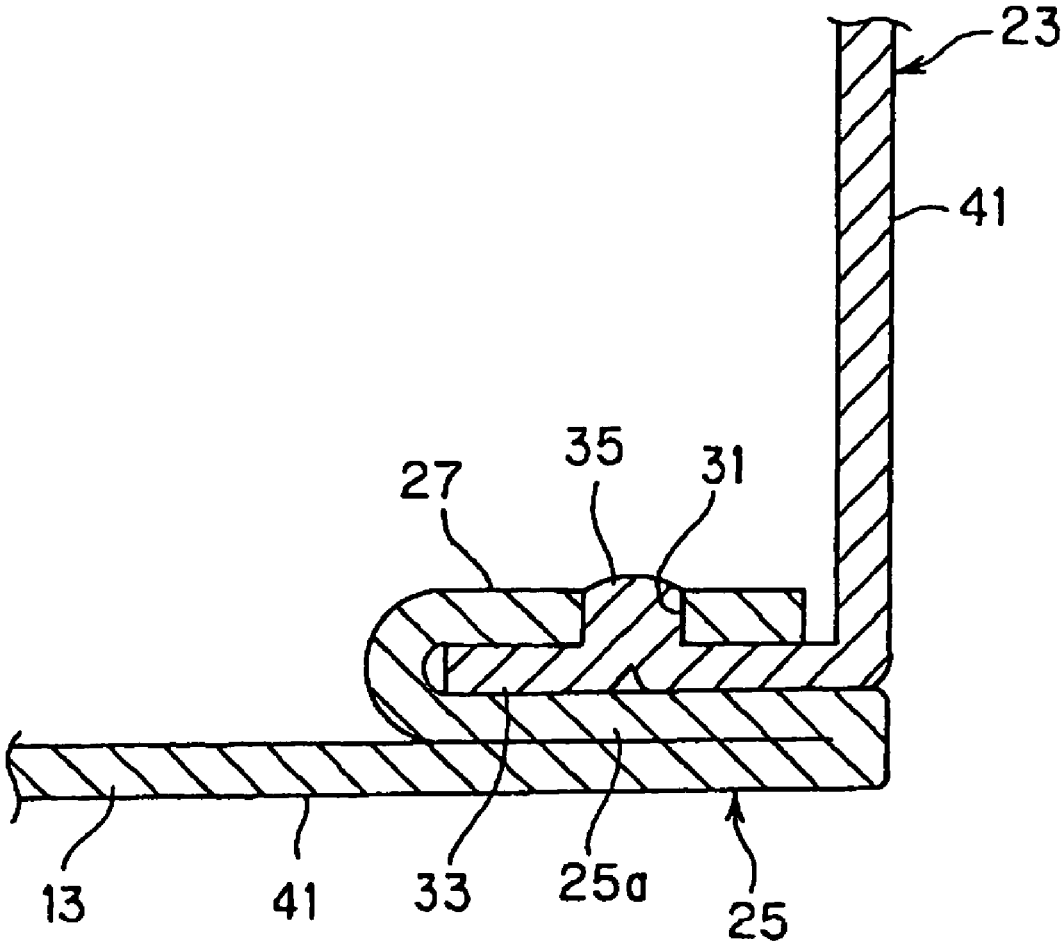
FIG. 4 is a sectional view showing a behavior after the calking step of FIG. 2.

FIG. 3 shows a section taken along a line A-A of FIG. 2 when the front plate and the inner box main body are integrated. According to the face plate of the inner box main body 23, a position of the face plate of the inner box main body 23 in a B direction relative to the front plate 13 is restricted by inserting the flange portion 33 of the bonding portion 28 into the clearance 29 between the first fold-to-bend portion 25 and the second fold-to-bend portion 27 to press in the B direction of the drawing. Further, by pressing a calking jig 37 in a direction of bonding the both under the state, the second fold-to-bend portion 27 of the front plate 13 is pressed to the side of the front plate 13 by fitting to insert the locking projections 35 of the flange portion 33 into the locking holes 31. As shown by FIG. 4, by the calking step, according to the front plate 13 and the face plate of the inner box main body, the first fold-to-bend portion 25, the flange portion 33, and the second fold-to-bend portion 27 are brought in to close contact with each other and bonded together substantially in parallel with each other. The locking projections 35 of the flange portion 33 are spread in the locking holes 31 by a pressure and inner peripheral faces of the locking holes 31 and the locking projections 35 are brought into face contact with each other to prevent from being drawn out. Further, by forming the locking hole 31 in the shape of the long hole, a dimensional error in sheet metal drawing is permitted.

Figure 5:
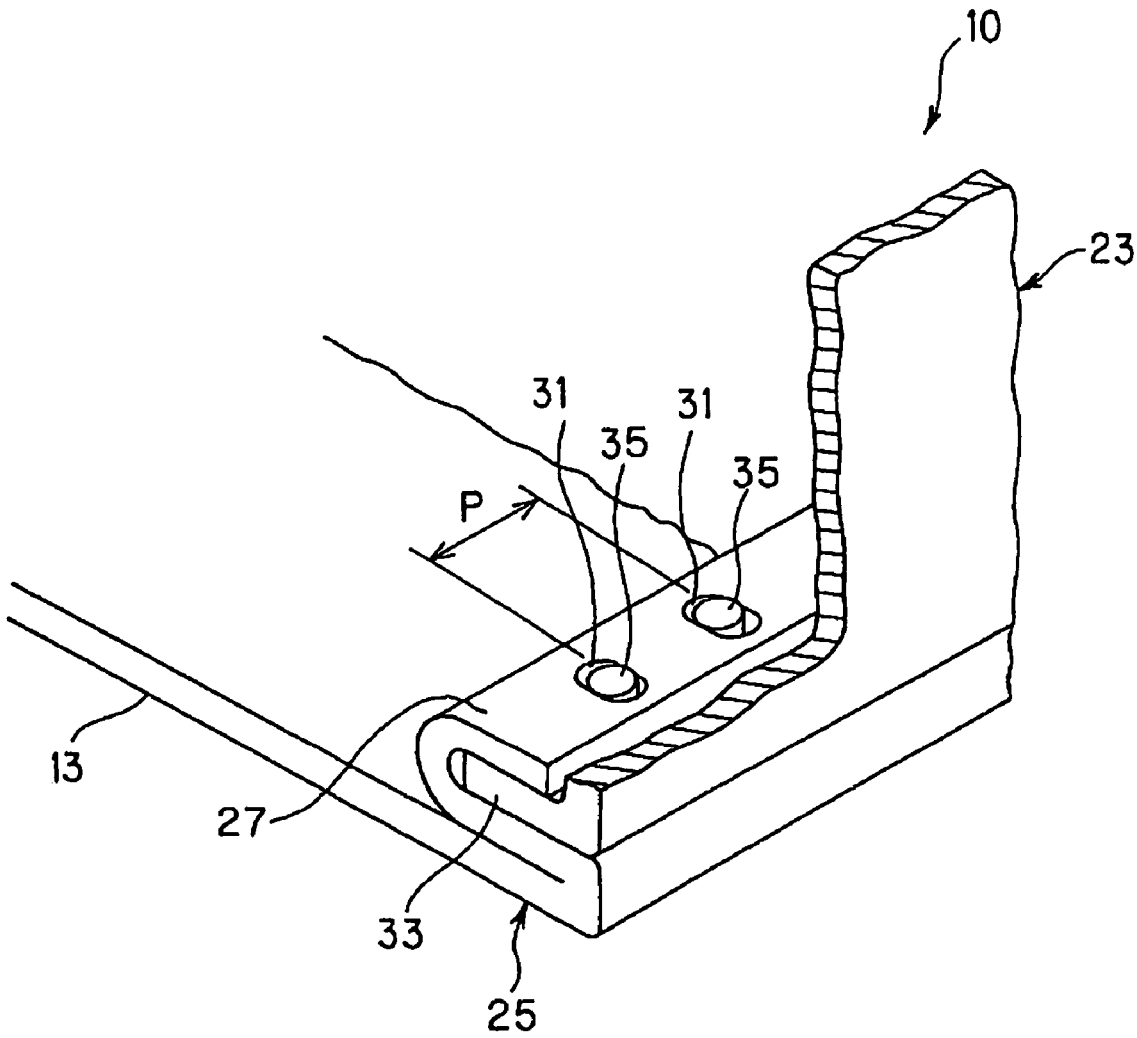
FIG. 5 is a partially disassembled outlook perspective view showing a state of a bonding portion after calking.

FIG. 5 shows a state of the bonding portion after calking by a perspective view. When the inner box 10 is used in a high frequency cooker, by constituting a pitch P in the peripheral edge direction of the locking projections 35 and the locking holes 31 to be equal to or smaller than ¼ of a wave length of a high frequency wave, the leakage of radio wave to outside of the box can be prevented.

Further, when the inner box 10 is used for a high frequency cooker, in order to achieve a radio wave shielding effect at inside and outside of the box, the respective face plates need to conduct and for that purpose, the bonding portions between the respective face plates need to electrically conduct. However, one surface of each of the front plate 13 and the face plates of the inner box main body 23 is formed with a surface treatment coating having an electrically insulating property of a precoated metal or the like, according to the above-described integrating method of integrating the flange portion 33 into the clearance 29 between the first fold-to-bend portion 25 and the second fold-to-bend portion 27, both of the front plate 13 and the face plates of the inner box main body 23 are brought into contact with each other on sides of insulating faces thereof to bring about an unconducted state. Hence, the both can be brought into a conducted state by providing the locking holes 31 and the locking projections 35 inserted there into as shown by FIG. 4.

That is, the inner peripheral face of the locking hole 31 shown in FIG. 4 is not formed with a surface treatment coating (insulating film) 41 to constitute a conducted face. Further, a surface on a side of projecting the locking projection 35 is a face on a side opposed to a side of forming the surface treatment coating 41 and is a matrix metal face having a conductivity. Therefore, by bringing the locking projection 35 having the conducted face into contact with the inner peripheral face of the locking hole 31 constituting the conducted face, the front plate 13 and the face plate of the inner box main body 23 are electrically connected and an excellent radio wave shielding effect is achieved.

Further, with regard to the locking hole 31 and the locking projection 35, when it is not necessary to electrically connect the face plates to be bonded and a problem of a positional shift, a bonding strength or the like is not severe at all, there may be constructed a constitution dispensing with the locking hole 31 and the locking projection 35. In this case, a simple bonding structure can be constituted.

Next, an explanation will be given of a method of integrating the above-described inner box for a cooker.

Figure 6:
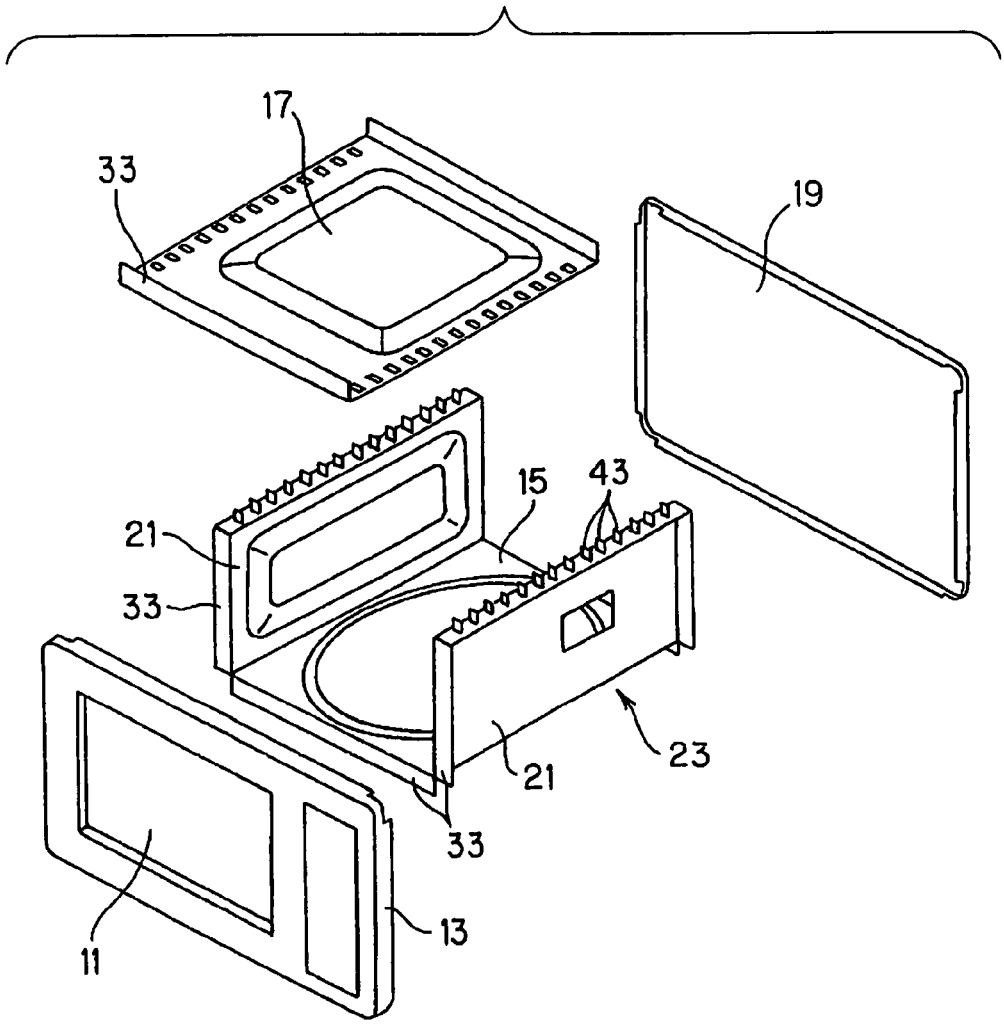
FIG. 6 is a disassembled view of an inner box for a cooker.
Figure 7:
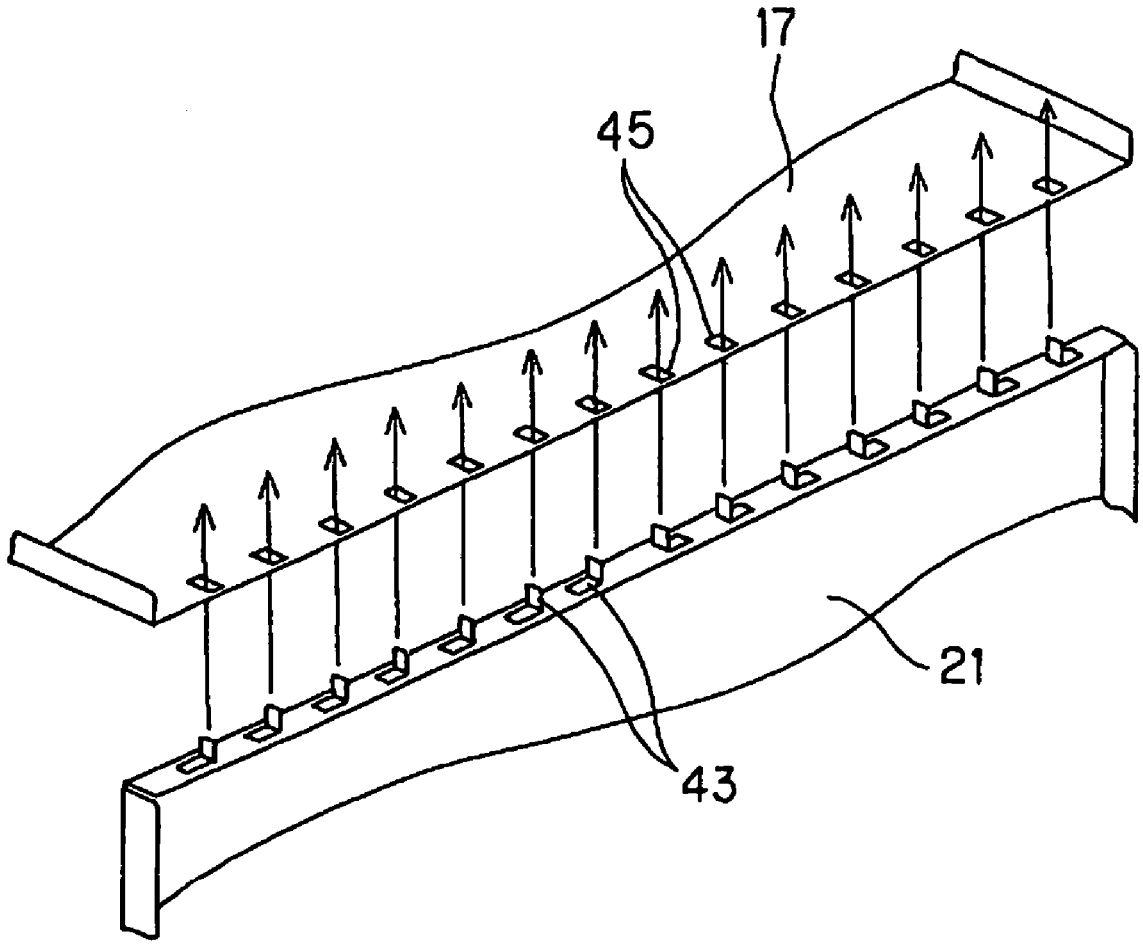
FIG. 7 is an explanatory view showing an example of bonding an inner box main body and a ceiling plate.

FIG. 6 shows a disassembled view of the inner box for a cooker and FIG. 7 shows an example for bonding the inner box main body and the ceiling plate.

The inner box main body 23 is formed by constituting a frame member having a section in a rectangular shape by the side plates 21, 21 and the bottom plate 15 by pressing one sheet plate and bonding the ceiling plate 17 to a side of an opening of the frame member (an upper face in the drawing) by calking to bond or welding by spot welding, or by engaging a locking claw 43 and a locking hole 45 as shown in FIG. 7. The inner box main body 23 bonded with the four faces is made to overlap the peripheral edge portion of the opening portion 11 of the front plate 13 to bring respective end portions of the four faces into a meshed state as shown by FIG. 3. That is, there is constituted a state of inserting the flange portions 33 of the respective face plates of the inner box main body 23 into the clearances 29. Further, sides thereof are successively calked to bond by the calking jig side by side.

According to such an integrating method, even when the sides are successively calked to bond side by side, the sides are not shifted relative to contiguous ones of the face plates in the height direction as mentioned above and therefore, the sides can be bonded without producing warping by the height shift. Further, the pressure required for the calking step is made to be smaller than that in the case of simultaneously calking to bond the four sides to the front plate 13 after bonding four sheets of the face plates of the inner box main body 23. Therefore, the calking step can be carried out by a small-sized pressing apparatus, large-sized formation of the calking apparatus is restrained and an integrating step can be carried out at low cost. Further, with regard to the method of integrating the inner box main body 23, other than the above-described method, a section in a shape of a square cylinder may be constituted by pertinently bonding the face plate to the frame member having three sides of square, further, the invention is not limited to the section having tree sides but the section in the shape of the square may finally be formed by pertinently combining single sheets of the face plates or two sheets or more of the face plates. That is, the inner box main body 23 may be integrated by a most pertinent method from various integrating methods in consideration of a purpose of use, a material, a fabrication efficiency or the like of the inner box, and even a method other than the integrating method exemplified in the embodiment can be provided to the invention without hindrance.

According to the inner box for a cooker explained as described above, in bonding plate members in right angle as in bonding the face plate of the inner box main body 23 to the front plate 13, whereas at least either one of the bonding portions of the front plate 13 and the inner box main body 23 is formed with the first fold-to-bend portion constituted by folding to bend the end portion to invert to be brought into close contact therewith and the second fold-to-bend portion constituted by inverting the portion on the side of the end portion of the first fold-to-bend portion with the predetermined clearance therebetween, other of the bonding portions of the front plate 13 and the inner box main body 23 is formed with the flange portion inserted into the clearance between first fold-to-bend portion and the second fold-to-bend portion and the bonding portions of the front plate 13 and the inner box main body 23 are constituted by the structure in which the flange portion is inserted into the clearance to be calked to bond, thereby, the calking step can be carried out without requiring a large-sized equipment and fabricating cost can be restrained.

That is, there is provided the calking step of bringing the second fold-to-bend portion 27 into press contact with the first fold-to-bend portion 25 via the flange portion 33 in a state in which the flange portion 33 is brought into contact with the first fold-to-bend portion 25 which has already been formed to fold to bend and therefore, calking is carried out at a position at which the face plate of the inner box main body 23 is brought into contact with the front plate 13 and there is hardly a positional shift between the face plate and the front plate 13 between before calking and after calking. That is, no influence is effected to the contiguous face plate. Further, calking is not carried out in one motion to the entire periphery of the bonding portion by the large pressure but calking is carried out separately and therefore, bonding is carried out by comparatively small pressure. Therefore, an integrating process can be simplified without needing a large amount of equipment investment.

Further, the second fold-to-bend portion 27 is formed with the locking hole 31, the flange portion 33 is formed with the locking projection 35 to be inserted into the locking hole 31 and therefore, even when an unconductive surface treatment is carried out on the surface of the front plate 13 or the inner box main body 23, a conductive path is formed by the locking hole 31 of the front plate 13 and the locking projection 35 of the flange portion 33, the radio wave shielding effect can be achieved without being influenced by the insulating surface treatment coating. Further, by bringing the locking projection 35 into face contact with the inner peripheral face of the locking hole 31 by calking, conduction can firmly be ensured. Further, by both of the locking hole 31 and the locking projection 35, the shift in the bonding position is difficult to be brought about.

Figure 8:
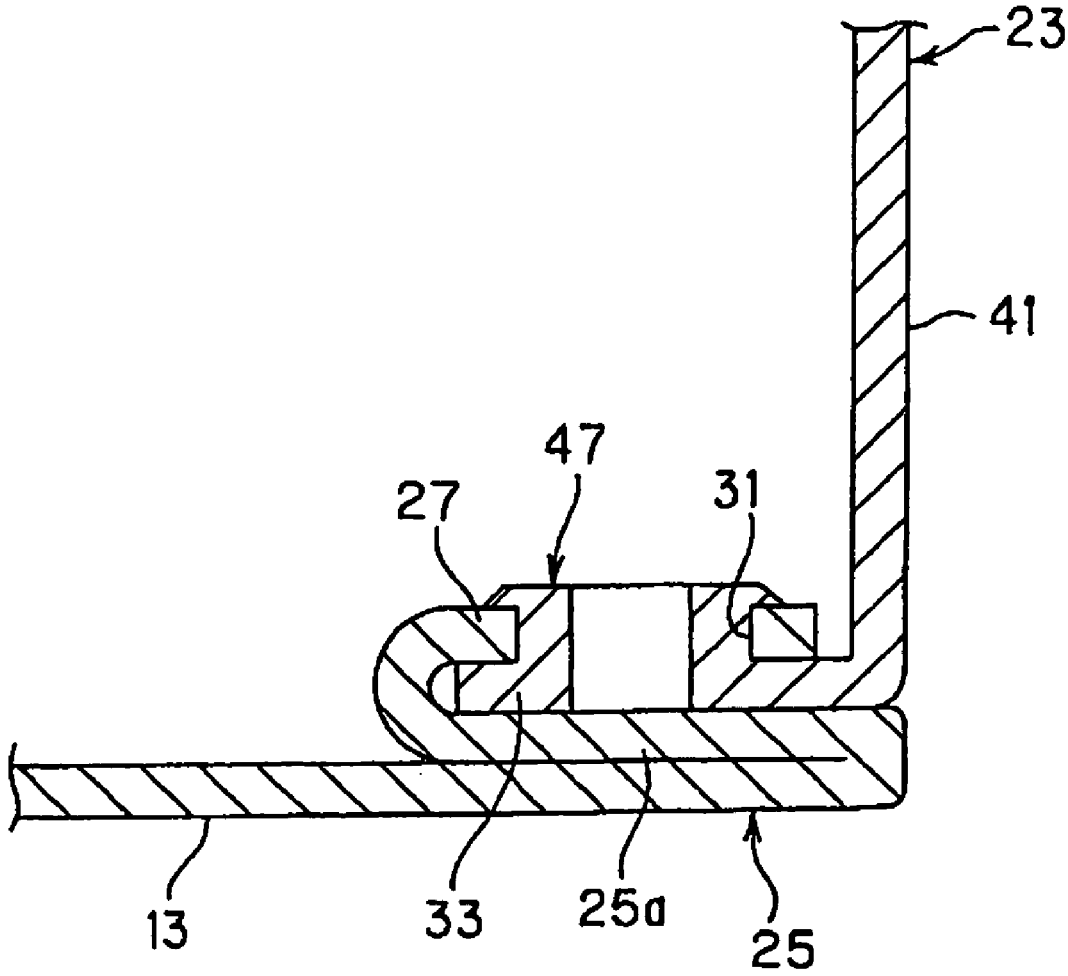
FIG. 8 is a sectional view of an example of constituting a locking projection formed at a flange portion by a drawn round hole projection.
Figure 9:
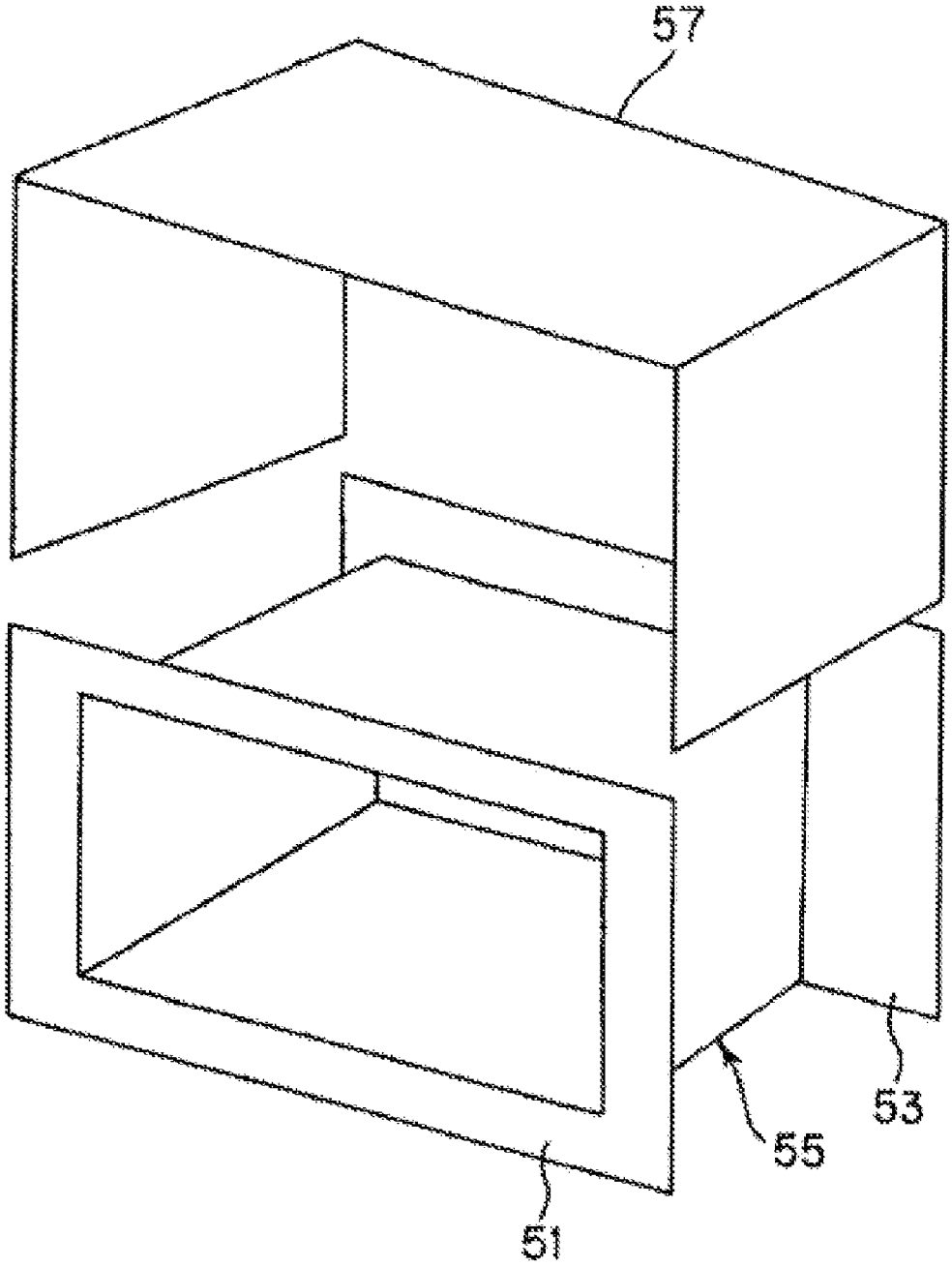
FIG. 9 PRIOR ART
FIG. 9 is a conceptual perspective view showing a plate constitution of an inner box for a cooker of a prior art.
Figure 10:
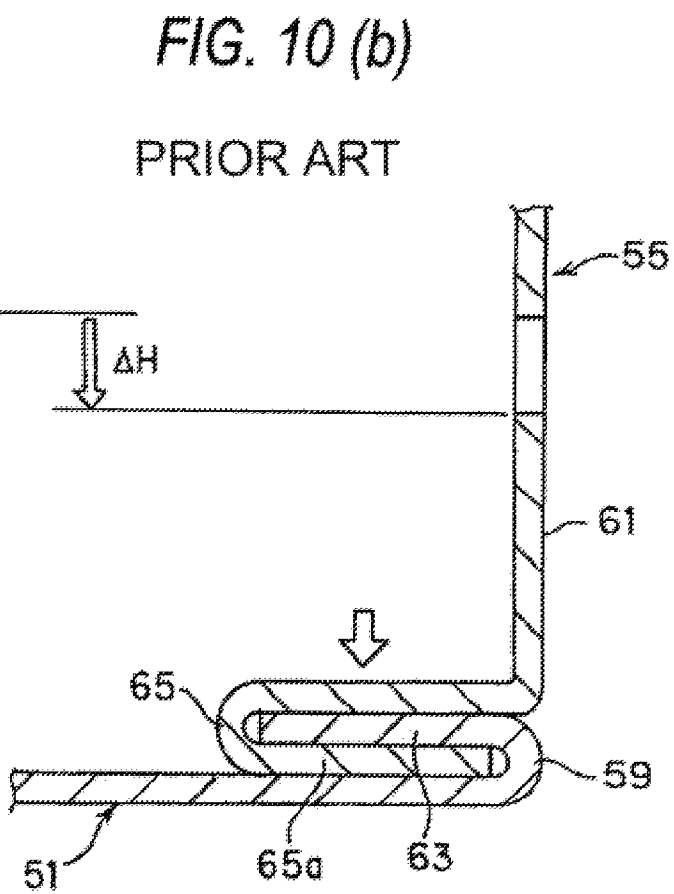
FIG. 10 (b) PRIOR ART
FIGS.10(*a*) and 10(*b*) illustrate views showing a calking step of the conventional art, FIG. 10(*a*) is an explanatory view showing a state before being calked to bond and FIG. 10(*b*) is an explanatory view showing a state after being calked to bond.
Figure 10:
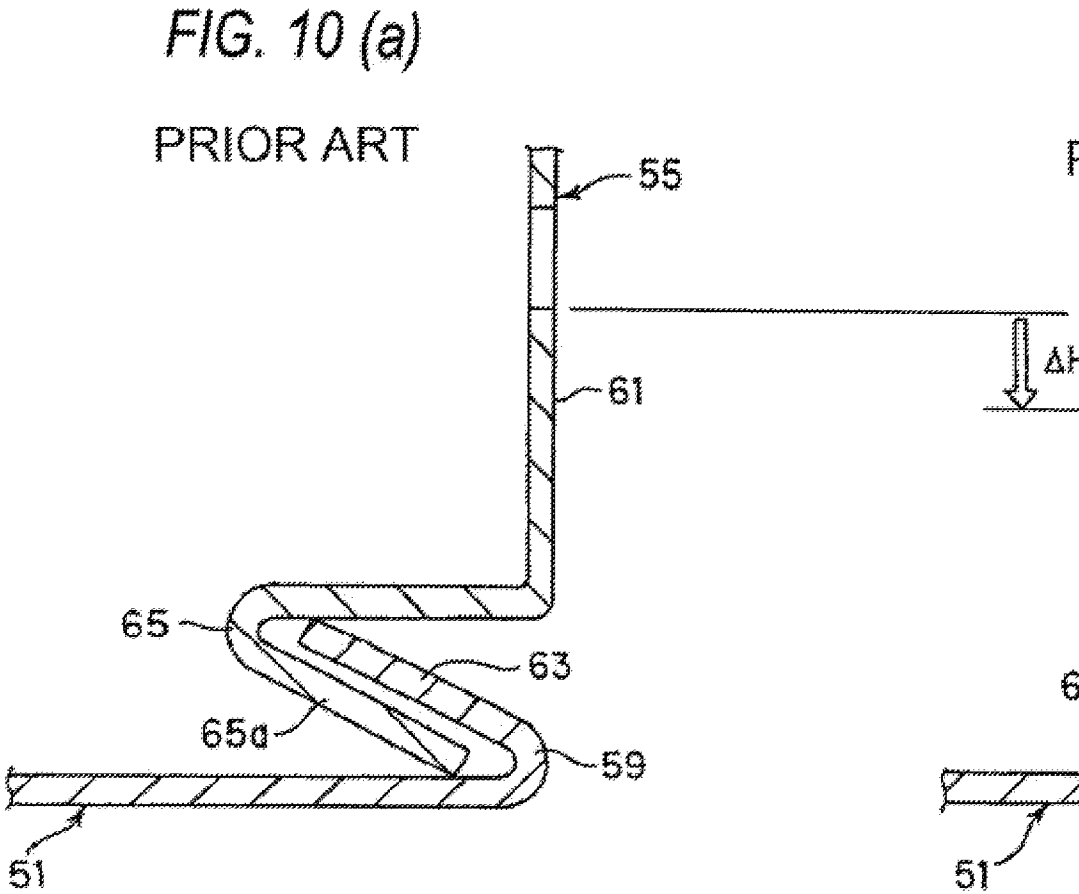
FIG. 10 (a) PRIOR ART

Next, an explanation will be given of a second embodiment of an inner box for a cooker according to the invention. FIG. 8 is a sectional view of an example for constituting a locking projection formed at a flange portion by a drawn round hole projection. According to the embodiment, a drawn round hole projection 47 having an opening hole is formed at an end portion of a face plate of a inner box main body by drawing and the drawn round hole projection 47 is inserted into the locking hole 31 of the front plate 13 to be calked to bond. In this way, the shape of the locking projection may be constituted by a shape brought into contact with the inner peripheral face of the locking hole 31 to lock to thereby achieve operation and effect similar to above-described.

Further, the inner box for a cooker according to the invention is not limited to the above-described embodiments but can pertinently be modified or improved. For example, similar operation and effect are achieved even when the front plate 13 is formed with the flange portion and the respective face plates of the inner box main body are formed with the first fold-to-bend portions and the second fold-to-bend portions to combine.

According to the inner box for a cooker of the invention, whereas at least one of the bonding portions of the front plate and the inner box main body is formed with the first fold-to-bend portion constituted by folding to bend the end portion to invert to be brought into close contact therewith and the second fold-to-bend portion constituted by inverting the portion of the side of the end portion of the first fold-to-bend portion with the predetermined clearance therebetween, other of the bonding portions of the front plate and the inner box main body is formed with the flange portion inserted into the clearance between the first fold-to-bend portion and the second fold-to-bend portion and the bonding portions of the front plate and the inner box main body are constituted by the structure of inserting the flange portion into the clearance to be calked to bond, thereby, the positional shift of the face plate is not brought about between before and after the calking step and the calking step can simply be carried out.

Further, according to the method of integrating the inner box for a cooker, by bonding four sheets of the face plates to be connected with the front plate to the front plate individually for the respective face plates, the calking step can be carried out by a comparatively small pressure without requiring a large-sized equipment and the fabricating cost can be restrained.

What is claimed is:

1. An inner box for a cooker, comprising:

a front plate having an opening portion; and an inner main body bonded to a peripheral edge of the opening portion for cooking at inside of the inner main body;

wherein at least either one of bonding portions of the front plate and the inner main body includes a first fold-to-bend portion constituted by folding to bend an end portion thereof to invert to be brought into close contact therewith, and a second fold-to-bend portion constituted by inverting a portion on a side of an end portion of the first fold-to-bend portion with a predetermined clearance therebetween, and wherein other of the bonding portions of the front plate and the inner main body includes a flange portion inserted into the clearance between the first fold-to-bend portion and the second fold-to-bend portion, and calked to bond, wherein the second fold-to-bend portion has a locking hole and the flange portion has a locking projection that extends through the locking hole, wherein insulating films are formed on a surface of the front plate on a side opposed to a side of being connected with the inner main body and an outer side surface of the inner main body, and wherein an inner peripheral portion of the locking hole is not formed with the insulating film and constitute a conducted face, and a surface of the main body portion of the locking projection is a metal face having conductivity, and wherein the locking projection is formed on the surface on which the insulating films are not formed, and therefore a front plate and a face plate of the inner box main body are electrically connected.

2. An inner box for a cooker, comprising:

a front plate having an opening portion; and an inner main body bonded to a peripheral edge of the opening portion for cooking at inside of the inner main body;

wherein at least either one of bonding portions of the front plate and the inner main body includes a first fold-to-bend portion constituted by folding to bend an end portion thereof to invert to be brought into close contact therewith, and a second fold-to-bend portion constituted by inverting a portion on a side of an end portion of the first fold-to-bend portion with a predetermined clearance therebetween, and wherein other of the bonding portions of the front plate and the inner main body includes a flange portion inserted into the clearance between the first fold-to-bend portion and the second fold-to-bend portion, and calked to bond, wherein the second fold-to-bend portion has a locking hole and the flange portion has a locking projection that extends through the locking hole, wherein the locking projection is a projection formed by punching machining, wherein insulating films are formed on a surface of the front plate on a side opposed to a side of being connected with the inner main body and an outer side surface of the inner main body, and wherein an inner peripheral portion of the locking hole is not formed with the insulating film and constitute a conducted face, and a surface of the main body portion of the locking projection is a metal face having conductivity, and wherein the locking projection is formed on the surface on which the insulating films are not formed, and therefore a front plate and a face plate of the inner box main body are electrically connected.

* * * * *

UNITED STATES PATENT AND TRADEMARK OFFICE

CERTIFICATE OF CORRECTION

PATENT NO. : 7,586,069 B2
APPLICATION NO. : 10/800062
DATED : September 8, 2009
INVENTOR(S) : Inoue et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 934 days.

Signed and Sealed this

Fourteenth Day of September, 2010

David J. Kappos

David J. Kappos
*Director of the United States Patent and Trademark Office*